United States Patent [19]

Goodson et al.

[11] Patent Number: 5,046,439

[45] Date of Patent: Sep. 10, 1991

[54] HULL FOR AN INBOARD POWERED BOAT

[75] Inventors: Norman R. Goodson; William D. Farris, both of Maryville, Tenn.

[73] Assignee: MasterCraft Boat Company, Maryville, Tenn.

[21] Appl. No.: 384,565

[22] Filed: Jul. 24, 1989

[51] Int. Cl.[5] ..... B63B 1/00

[52] U.S. Cl. ..... 114/56; 114/271

[58] Field of Search ..... 114/56, 289, 271, 290, 114/291; D12/300, 313, 314

[56] References Cited

U.S. PATENT DOCUMENTS

| | | | |
|---|---|---|---|
| 3,298,343 | 1/1967 | Juhnke | 114/56 |
| 3,776,168 | 12/1973 | Weeks | 114/56 |
| 4,655,157 | 4/1987 | Sapp | 114/56 X |
| 4,753,184 | 6/1988 | Schiavone | 114/56 |
| 4,915,048 | 4/1990 | Stanford | 114/56 |
| 4,958,585 | 9/1990 | Caldwell | 114/271 |

FOREIGN PATENT DOCUMENTS

| | | |
|---|---|---|
| 2014515A | 8/1979 | United Kingdom . |
| 2226532A | 7/1990 | United Kingdom . |

*Primary Examiner*—Ed Swinehart

*Attorney, Agent, or Firm*—Tilton, Fallon, Lungmus

[57] ABSTRACT

An improved hull is disclosed for use on an inboard boat of a relatively increased length, the hull having a generally deep V-shaped bottom surface at the bow slowly transitioning to a relatively flat stern to provide increased lift as compared to conventional inboard boats, to provide a smooth ride yet permit maximized speed and stability for water skiing use, to provide the desirable handling characteristics (such as for turning and maneuverability) found in an inboard boat of relatively shorter length, and to produce a minimal wake for water skiing purposes. The hull is formed with a series of longitudinally-aligned pairs of strakes which, over the majority of their respective lengths, have a negative strake angle. Through the specific placement, the longitudinal commencement and termination, of the respective pairs of strakes, they provide increased lift, improved turning ability, and reduced wake side spray. A progressively-changing deadrise angle is formed into the hull which angle, from bow to stern, generally decreases from approximately 35° relative to horizontal to approximately 9.5°.

5 Claims, 4 Drawing Sheets

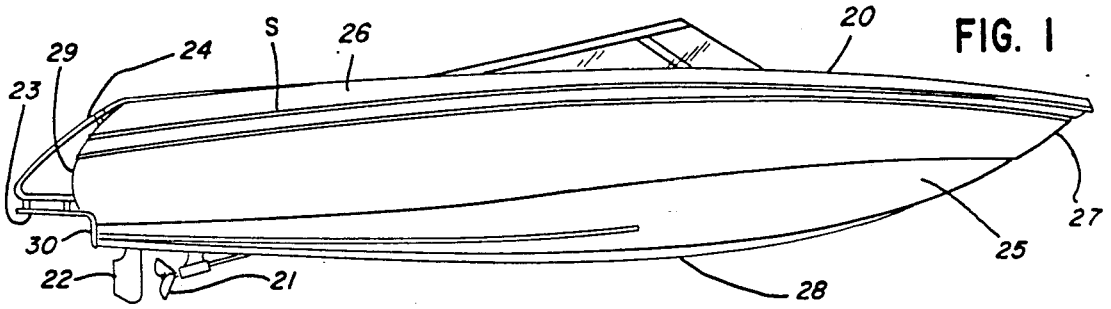
FIG. 1
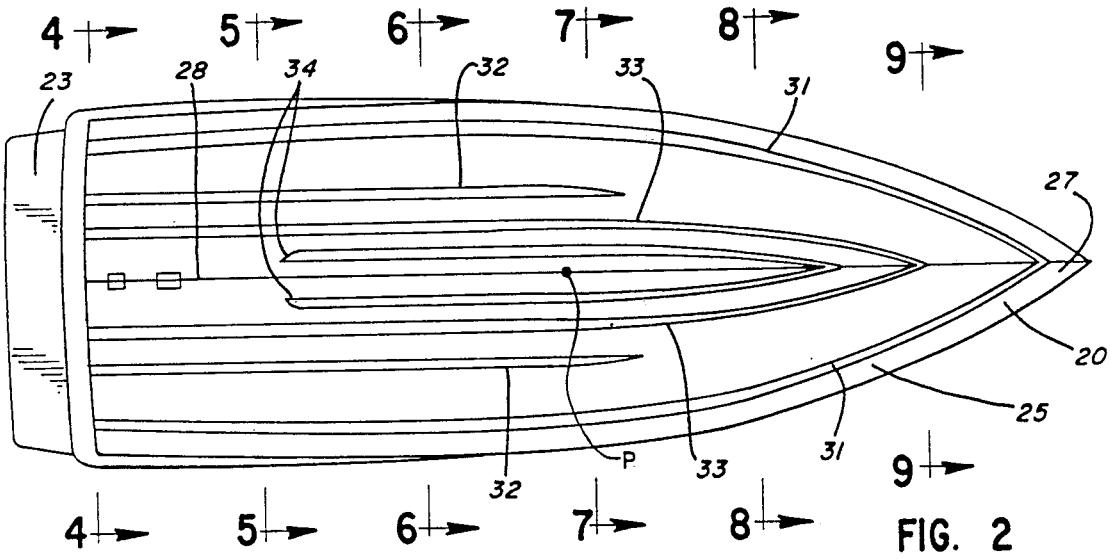
FIG. 2
FIG. 3
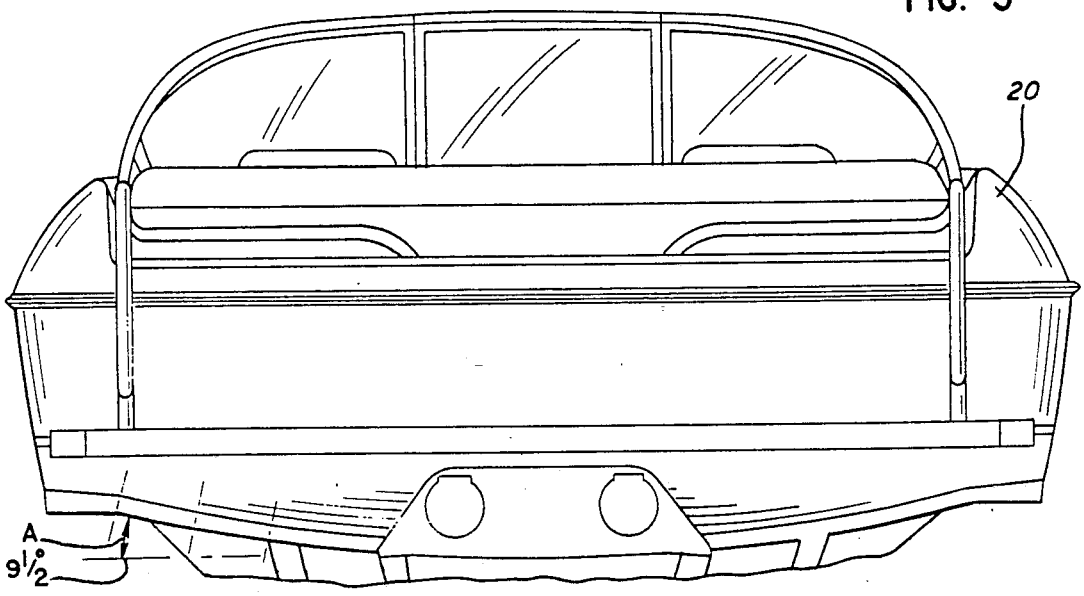

FIG. 8
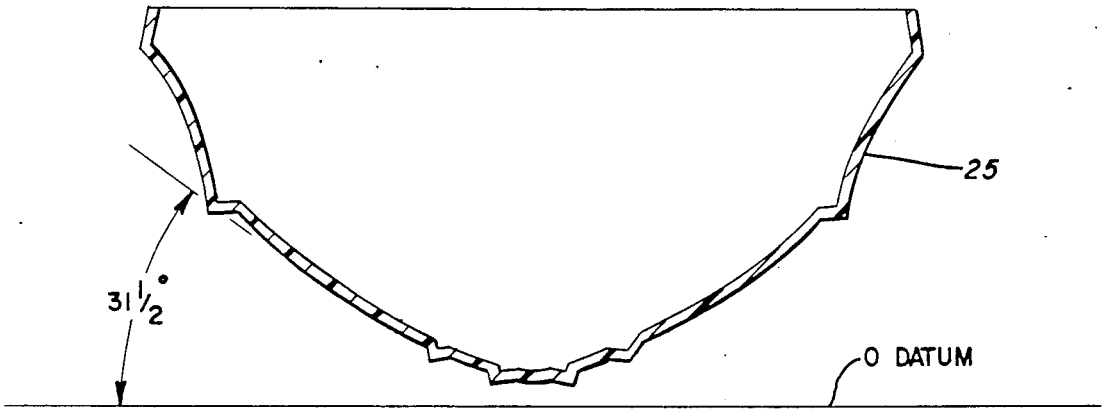
FIG. 9
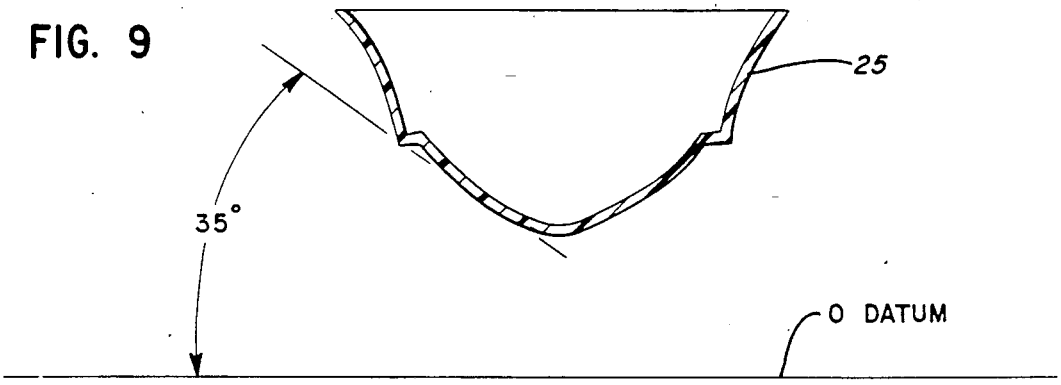
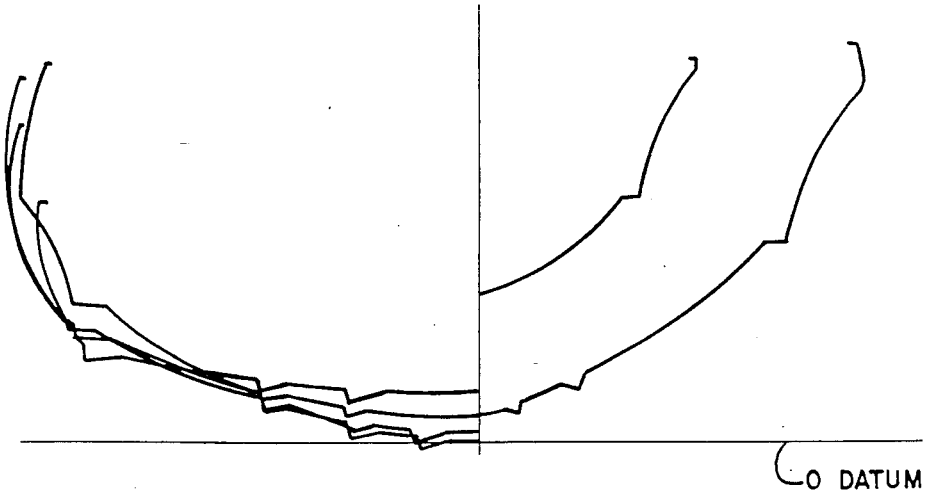
FIG. 10

HULL FOR AN INBOARD POWERED BOAT

BACKGROUND OF INVENTION

1. Field of Invention

This invention relates to an improved hull design for boats, and particularly for use on a hull for relatively long inboard boats, such as inboard ski boats.

2. Prior Art

It has long been known that, for use in water-skiing and other similar water sports requiring a boat, an inboard boat provides distinct advantages in pulling power, tracking and stability, i.e., having the boat remain relatively flat in turns, over outboard or stern-drive boats. However, there are disadvantages present in conventional inboard boat hulls in that the longer the inboard boat was, the less lift could be achieved. This decreased lift resulted in increased drag, i.e., less fuel efficiency and a reduced speed for a boat with an engine of given horsepower. Also, with inboard boats having conventional hull designs, many required downwardly-extending, fixed tracking fins positioned midship adjacent the keel. These were required to assure proper turning and tracking, i.e., straight-line stability, of the inboard boat. Also, many inboard boats having a so-called relatively "deep Vee" configuration which ran the entire length of the boat suffered from restricted turning ability.

The present invention overcomes the foregoing disadvantages of prior inboard boat hull design by combining a series of respective pairs of strakes, each pair having a specific placement, and a specific longitudinal commencement and termination, with a hull deadrise angle that progressively decreases from bow to stern. Such a gradual transition from an essentially deep-V configuration for the bow of the boat, to an essentially flattened deadrise for the stern of the boat, done in a smooth progression, i.e., smooth transition, over the length of the boat, permits a boat made in accordance with the present invention to provide a smooth ride, such as when entering and cutting through waves by the bow, yet permits maximized speed, stability in turns, and a small wake. The sharp entry deadrise angle of a deep vee hull allows the present inboard to have the good ride characteristics that are present in stern drive and outboard boat hulls, which type boats normally have a constant deadrise from bow to stern.

Further, the general deadrise transition of the present invention coupled with the specific configuration and placement of respective pairs of strake members permits the boat to lift up out of the water, unlike a conventional inboard boat of similar length, and plane with the least amount of wetted surface area required to properly handle the boat. Thus, with a boat made in accordance with the present invention, much less horsepower per pound of hull is required to achieve the same speed as hulls of prior designs.

It is known that an inboard boat becomes very inefficient at higher speeds compared to an outboard or stern-drive boat, i.e., inboard/outboard boat. This is because the propeller cannot be angled to lift the hull out of the water. Thus, to achieve maximum efficiency in a large inboard boat, i.e., one of relatively long length, the hull design had to plane quickly and lift out of the water at higher speeds. Advantageously, the hull design of the present invention permits this to occur by a combination of a variable deadrise angle and the specific placement and configuration of the strakes.

Thus, it is an object of the present invention to provide a hull for a relatively long inboard boat which provides a smooth ride, a reduced wake, improved handling, and maximized speed.

It is a further object of the present invention to provide an inboard boat hull having a gradual, progressive transition in deadrise angle for use in an inboard boat application, without creating any unnecessary drag in the boat as it planes through the water. That is, the smooth transition assures that there is no so-called "hook", i.e., concave area in the bottom of the hull in the wetted surface area when the boat is running, to cause a drag on the hull and reduce the boat's overall performance.

It is yet a further object of the present invention to provide an inboard boat hull which has an improved transition of deadrise angle from bow to stern combined with a series of specially configured and placed pairs of strakes, which combination provides a relatively long inboard boat with a smooth ride yet the handling and speed of a much shorter inboard boat.

The means by which the foregoing and other objects of the present invention are accomplished and the manner of their accomplishment will be readily understood from the following specification upon reference to the accompanying drawings, in which:

BRIEF DESCRIPTION OF THE DRAWINGS

FIG. 1 is a side elevational view of the boat having the hull of the present invention;

FIG. 2 is a bottom plan view of the boat;

FIG. 3 is a rear end view of the boat;

FIG. 8 is a sectional view taken along line 8—8 of FIG. 1;

FIG. 9 is a sectional view taken along line 9—9 of FIG. 1;

FIG. 10 is a composite sectional view of various cross sections through the boat, viewed from the bow, with certain chine and strake elements omitted for clarity, and reflecting the deadrise angle transition from bow to stern.

DESCRIPTION OF THE PREFERRED EMBODIMENT

Figure 4:
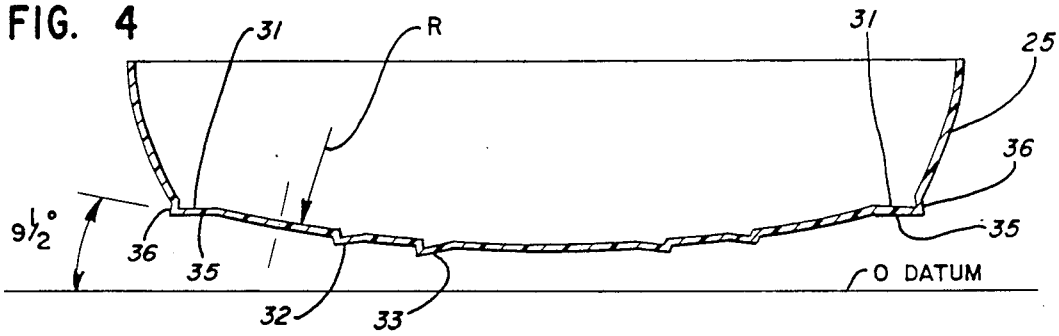
FIG. 4 is a sectional view taken along line 4—4 of FIG. 1.
Figure 5:
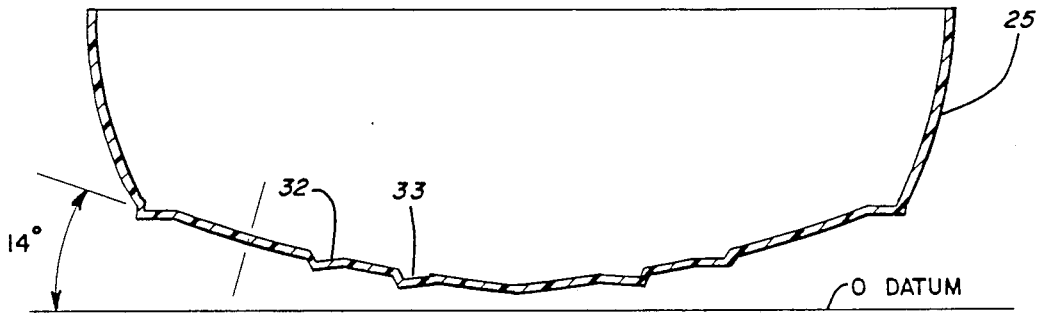
FIG. 5 is a sectional view taken along line 5—5 of FIG. 1.
Figure 6:
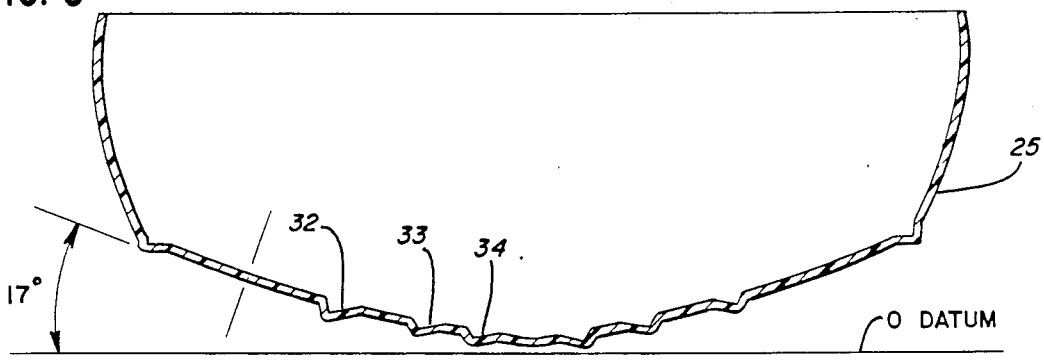
FIG. 6 is a sectional view taken along line 6—6 of FIG. 1.
Figure 7:
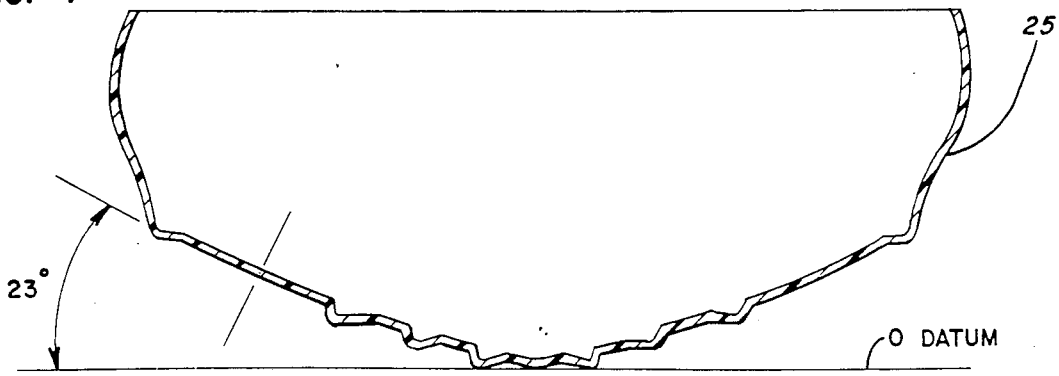
FIG. 7 is a sectional view taken along line 7—7 of FIG. 1.
Figure 11:
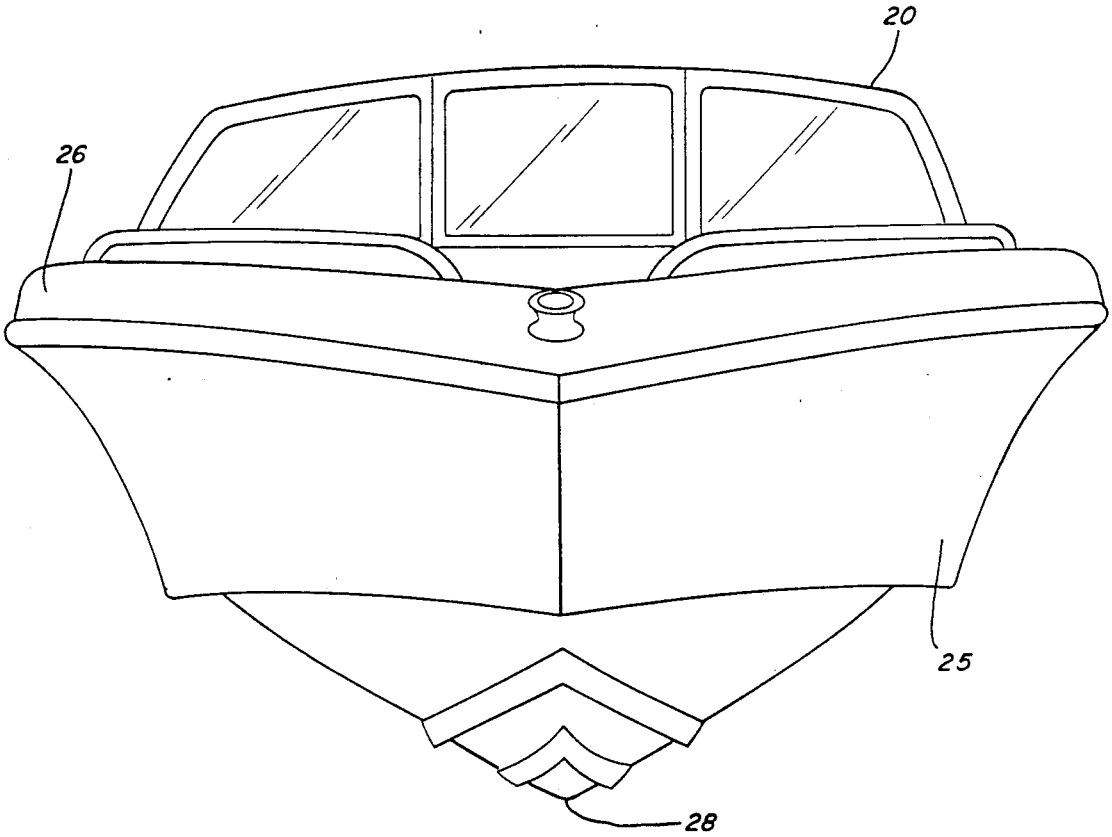
FIG. 11 is a front end view of the boat.

Having reference to the drawings, wherein like reference numerals indicate corresponding elements, there is shown in FIG. 1 an illustration of an inboard power boat which is generally denoted by reference numeral 20. Boat 20 is powered by an inboard motor (not shown) which drives a propeller 21 across a rudder 22. The particular boat shown in FIG. 1 is the type inboard having an open cabin area and a ski platform 23 and hand rails 24; it is the type boat typically used for water skiing and other surface water sports. However, it will be understood that the invention is not limited to any particular kind of boat. For example, the boat 20 could be fitted with, instead of an open cabin, a partially enclosed sport cabin, and the platform 23 and rails 24 could be deleted as desired.

The boat 20 includes a hull 25, and a deck 26 secured to the hull at a sheer line S. The hull 25 has a bow 27, a keel area 28, a stern 29, and a transom 30. The hull 25, at least at the bow end, is generally V-shaped in transverse cross section.

As seen in FIG. 2, the hull 25 includes a pair of chines 31, 31, and three respective pairs of strakes, namely an outer pair of strakes 32, 32, a middle pair of strakes 33, 33, and a center pair of strakes 34, 34. Preferably, all the respective pairs of strakes 32, 33, and 34 are formed so as to be parallel to the keel 28.

As best seen in FIG. 4, each chine 31 comprises a generally horizontal bottom surface 35 and a generally vertical side surface 36. Preferably, the bottom surface 35 of each chine 31 is formed at a negative angle relative to the boat, such that near the bow 27 (see FIG. 9) the chines 31, 31 have a negative angle of 4°, but thereafter taper off along their length toward an angle at the stern 29 of 0°, since the chines 31, 31 are under water at that point when the boat 20 is in running operation.

The respective pairs of strakes 32, 33 and 34, are similarly reverse-angled, such that towards the bow end 27, the outer strakes 32, 32, start at a reverse angle of 4° and along their length towards the stern 29 taper to 0° angle, the middle pair of strakes 33, 33 start at their bow end at a reverse angle of 4° and taper over their length to 2° at the stern 29, while the center pair of strakes 34, 34 tapers from 4° towards the bow to 2° near the propeller 21.

The presence, position, i.e., location of commencement and termination, configuration, and relative length, of the respective pairs of strakes 32, 33, and 34 are all important to the overall operation of the present boat hull 25 when in water (not shown). That is, a boat was made in accordance with the preferred embodiment of the present invention and weighed 4,000 lbs. with a 454 cubic inch inboard engine and had an overall length of 24 ft. 10 in. (excluding the ski platform 23) and width of 7.22 ft. It was found that for such a boat the outer pair of strakes 32, 32, should commence at a point 13 ft. from the stern and run the length of the hull to the transom 30. The strakes 32, 32 provide lift during take off of boat 20 and also direct the water spray (not shown) downward before it reaches the chines 31, 31. Similarly, for the middle pair of strakes 33, 33, which provide a lift during take off and at high speeds, it was found that they should extend essentially the entire length of the boat hull 25, i.e., start at a point approximately 20 ft. from the stern. It has been found that the best relative distance between the outer facing edges of the adjacent respective strakes 33, 34 in a boat made in accordance with the present invention (having the data and characteristics which are given above) was approximately 14 inches.

Finally, for the center pair of strakes 34, 34 it was found that they should start at a point approximately 18 ft. from the stern and run to a point approximately 4.5 ft. from the stern. These center strakes 34, 34 are important in that they allow the boat hull 25 to catch in the water during turning maneuvers so that the boat 20 will turn very sharply, i.e., they help anchor the hull's keel area 28. That is, the turning point, i.e., pivot point, at which the hull 25 must pivot is located in the central area of the boat along keel 28, namely, at approximately the point P (see FIG. 2). Thus, the pair of strakes 34, 34, allow the inboard boat hull 25 to be anchored about such pivot point P, near the boat's midship area which point is approximately 11 to 12 ft. from the stern end on the above-described boat made in accordance with this invention. Importantly, however, it must be understood that the center strakes 34, 34 purposely terminate before the transom 30 so as to not interfere with the water passing in front of the propeller 21 and rudder 22. See FIG. 3, where the center pair of strakes 34, 34 do not show inasmuch as they terminate before the transom 30.

The use of the strategically placed pair of strakes 32, 33, and 34 permits the inboard boat 20 to require only a decreased wetted surface area of the hull 25, which in turn allows the boat 20 to be more efficient, i.e., the hull has less drag so less horsepower is required.

Preferably, in the boat made in accordance with the present invention (the weight and length of which were given above), the respective pairs of strakes 32, 33, and 34 are formed so that each respective strake is 3" in width and rises approximately $\frac{3}{4}$" away from the surface of the hull 25. However, with inboard boats of other lengths, widths, and weights, it will be understood that such strake width and strake height may vary as needed to allow the respective pairs of strakes to properly perform the above-described lifting, turning, and anchoring functions provided thereby.

Referring to FIG. 3, the generally V-shaped hull 25 of the present invention (shown at the stern end 29 in that FIGURE) has a deadrise or dihiedral angle denoted by letter A. Such a deadrise angle A is determined at a point substantially centrally located between the chine 31 and the outer strake 32, by measuring the angle between the bottom surface of the hull 25 and the horizontal, disregarding any discontinuities in the bottom surface caused by the respective pairs of strakes 32, 33, and 34, and the chines 31. Thus, in the boat made in accordance with the present invention (the weight, width and length of which were given above), the deadrise angle at the stern 29 is 9.5°. Also, with respect to FIG. 3, it will be understood that the surface of the hull 25 is generally of a convex shape having an overall radius R of 156 in. at the stern. Similarly, it will be understood that different radii (not shown) for the hull surface 25 are used for each of the other transverse cross sections of the hull as depicted in FIGS. 5–10, depending upon the deadrise angle present at such location.

The deadrise angle progressively increases at various transverse cross sections forward of the stern, which for reference purposes only are denoted as stations A4, A8, and A16 (see FIG. 2), and taken at four foot intervals. Accordingly, FIG. 5, which represents station A4, has a deadrise angle of 14°. Similarly, for stations A8 and A12, depicted respectively in FIGS. 6 and 7, the deadrise angles are respectively 17° and 23° for inboard hull 25 made into a 24 foot inboard boat.

The respective deadrise angle configurations for the hull 25 are also shown in FIG. 10, where on the left side thereof there are respectively designate transverse cross sections at points 4, 8 and 12 ft. from the stern, while the righthand portion of FIG. 8 designate respective transverse cross sections at 16, 20, and 24 ft. from the stern. Thus, it will be seen that there is a gradual transition in the deadrise angle from a maximum of 35° near the bow 27 for hull 25, to a substantially flattened deadrise angle of 9.5° at the stern.

To more graphically show the gradual hull deadrise transition over FIG. 10, please see the following chart:

| Station (In Feet) from Stern | Deadrise Angle |
|---|---|
| 0 (Stern) | 9.5° |
| 4 | 14° |
| 8 | 17° |
| 12 | 23° |
| 16 | 31.5° |
| 20 (Near Bow) | 35° |

By reason of the flatter hull configuration at the stern of the presently disclosed boat, this helps to keep the boat stable in turning maneuvers, similar in effect to the use of a sway bar in an automobile. This flatter hull configuration at stern end, when the boat is planing, is especially important when pulling a waterskier. That is, it helps keep the boat from rolling or pitching to one side such as when a skier is making a hard cut, i.e., in slalom skiing, which as a result puts a strong lateral pull on the ski plyon affixed to the boat and which normally would cause the boat to roll or pitch toward the direction of the pull.

It will be understood that the boat hull described herein is advantageously made in the conventional manner by laying down resin-impregnated fiberglass in a gel-coated mold. Such a molding procedure is well known, and the details thereof need not be described herein. The angles and dimensions which are referred to in this specification include the normal manufacturing tolerances for molded fiberglass hulls.

With the improved hull design of the present invention, it is found that for a boat made in accordance therewith (the length, width, and weight of which was previously given above) would advantageously run at a maximum cruising speed of 47 mph. Further, the same boat, but weighing only 3,700 lbs. (due to a smaller engine, namely a 351 cubic inch inboard engine), would run advantageously at a maximum cruising speed of approximately 40 mph.

From the foregoing, it is believed that those skilled in the art will readily appreciate the unique features and advantages of the present invention over previous types of hulls for boats, including inboards. Further, it is to be understood that while the present invention has been described in relation to a particular preferred embodiment as set forth in the accompanying drawings and as above described, the same nevertheless is susceptible to change, variation and substitution of equivalents without departure from the spirit and scope of this invention. It is therefore intended that the present invention be unrestricted by the foregoing description and drawings, except as may appear in the following appended claims.

We claim:

1. A hull for an inboard boat with a propeller disposed adjacent the stern end of the boat, said hull comprising: a bow portion which has a substantially V-shaped bottom in transverse cross section; a stern portion which has a substantially flat bottom in transverse cross section, said stern portion terminating in a stern end; and a midship portion whose bottom tapers from a V-shape to a substantially flat shape; said hull defining a keel area and a first pair of generally parallel strake portions straddling said keel area and lying adjacent thereto, said first pair of strake portions commencing at a point between said bow and said midship portions and extending to a point ahead of the propeller; said hull further defining a second pair of strake portions lying outwardly of said first pair of strake portions and commencing forwardly thereof and extending to said stern portion; said hull defining yet a third pair of strake portions lying outwardly of said second pair of strake portions and commencing rearwardly of said first and second pairs of strake portions and extending to said stern portion.

2. The hull of claim 1, wherein said second and third pairs of strake portions are generally parallel.

3. The hull of claim 1, wherein for an approximately 24 ft. boat, said third pair of strake portions commence at about 13 ft. from said stern end, and said first pair of strake portions commence at about 18 ft. from said stern end and terminate between 4 and 5 ft. from said stern end.

4. The hull of claim 1, wherein each respective strake portion has a negative strake angle over the majority of its length, such that said negative strake angle for said third pair of strake portions flattens from an approximately 4° negative angle at the bow end thereof to approximately 2° negative angle at the stern end thereof, said negative strake angle for said second pair of strake portions flattens from an approximately 4° negative angle at the bow end thereof to approximately 0° angle at the stern end thereof, and said negative strake angle for said first pair of strake portions flattens from approximately 4° negative angle at the bow end thereof to approximately 2° negative angle at the stern end thereof.

5. The hull of claim 1, wherein said hull has a bottom surface and generally vertical side surfaces, said hull defining chine portions for separating the lateral edges of said hull bottom surface from said generally vertical side surfaces, said chine portions having a negative chine angle over the majority of their lengths, wherein said negative chine angle for said chine portions flattens from approximately 4° negative angle at the bow end thereof to approximately 0° angle at the stern end thereof.

* * * * *